US006032995A

United States Patent [19]

Barbaro

[11] Patent Number: 6,032,995

[45] Date of Patent: Mar. 7, 2000

[54] APPARATUS FOR RETRIEVAL AND DISPOSAL OF PET FECAL

[76] Inventor: Guy Barbaro, 208 E. Beverly Pkwy., Valley Stream, N.Y. 11580

[21] Appl. No.: 09/206,605

[22] Filed: Dec. 7, 1998

[51] Int. Cl.[7] ..... A01K 29/00; E01H 1/12

[52] U.S. Cl. ..... 294/1.4; 15/257.3; 15/257.6

[58] Field of Search ..... 294/1.3–1.5, 55; 15/104.8, 257.1–257.4, 257.6, 257.7

[56] References Cited

U.S. PATENT DOCUMENTS

| | | | |
|---|---|---|---|
| 3,431,008 | 3/1969 | Narita | 294/1.4 |
| 3,986,744 | 10/1976 | Krogstad et al. | 294/1.3 |
| 4,042,269 | 8/1977 | Skermetta | 294/55 X |
| 4,200,321 | 4/1980 | Warkentin . | |
| 4,225,174 | 9/1980 | Hennessy et al. | 294/1.4 |
| 4,368,907 | 1/1983 | Ross . | |
| 4,741,566 | 5/1988 | Byung-Do et al. . | |
| 5,343,589 | 9/1994 | Davenport | 15/257.4 |
| 5,667,264 | 9/1997 | Tanahara . | |

FOREIGN PATENT DOCUMENTS

| | | | |
|---|---|---|---|
| 2631212 | 11/1989 | France | 294/1.4 |
| 288314 | 9/1931 | Italy | 15/257.6 |

*Primary Examiner*—Johnny D. Cherry
*Attorney, Agent, or Firm*—Michael I. Kroll

[57] ABSTRACT

The present invention 10 discloses a device for collecting animal waste. The device has a generally upright standing handle member 14 equipped with a trigger 16 which communicates through a rod 30 in the hollow body of the handle 14 with a lower compartment door assembly 18 for collecting the animal waste. The lower compartment 12 is equipped with a front door 18 which is pivotally connected 44 to the trigger 16 through the rod member 30. The lower compartment 12 houses a slidably mounted tray 20 therein which tray holds a disposable bag member 52 in which bag the animal waste is placed after it is scooped into the lower compartment 12. The trigger 16 is also equipped with a locking mechanism 17 to hold the door 18 open while waste is being placed therein.

9 Claims, 15 Drawing Sheets

APPARATUS FOR RETRIEVAL AND DISPOSAL OF PET FECAL

BACKGROUND OF THE INVENTION

1. Field of the Invention

The present invention relates generally to animal feces pickup devices and more specifically to an apparatus having a longitudinal member having connection means between the handle of said longitudinal member wherein a trigger mechanism is housed and a container having a mechanism located on one side and connected to said trigger whereby when said trigger is depressed the mechanism will forwardly open the end of the container wherein a disposable bag having been early inserted through the other open end of said container for the purposes of containing an amount of pet fecal material which will be scooped up at the hinged opening end and disposed of by removing said bag and discarding.

2. Description of the Prior Art

There are other retrieval devices designed to pick up animal waste, Typical of these is U.S. Pat. No. 4,200,321 issued to Warkentin on Apr. 29, 1980.

Another patent was issued to Ross on Jan. 18, 1983 as U.S. Pat. No. 4,368,907. Yet another U.S. Pat. No. 4,741,566 was issued to Byung-Do et al on May 3, 1988 and still yet another was issued on Sep. 16, 1997 to Tanahara as U.S. Pat. No. 5,667,264.

U.S. Pat. No. 4,200,321

Inventor: Ralph Warkentin

Issued: Apr. 29, 1980

An improved sanitation device for the collection of animal feces is provided. The device includes a longitudinal frame, a handle attached to one end of the frame, and a receptacle attached to the other end of the frame and having a first and second open end. A scoop arm is pivotally attached to an intermediate portion of the frame. A scoop is attached to the scoop arm and constructed and oriented for engagement and registry with an open end of the receptacle when the device is in a closed position. A spring between the scoop arm and the frame forcibly urges the two apart. A trigger is provided for actuating the scoop arm and is held by as trigger retainer at a convenient position relative to the handle so that the handle may be grasped by a hand while engaging the trigger with the fingers. A disposable receptacle detachably engages the second open end of the intermediate receptacle.

U.S. Pat. No. 4,368,907

Inventor: Bernard M. Ross

Issued: Jan. 18, 1983

A device for use in gathering and removing animal waste and other debris including a compartmented container assembly having first and second compartments formed therein, the container assembly having first and second end portions and a central opening extending therethrough, a first closure member pivotally mounted to the first end portion of the container assembly to control access to the first compartment, a second closure member disposed at an intermediate location between the first and second end portions of the container assembly across the central opening separating the container into the first and second compartments, the second closure member being movable between a normally closed position separating the first and second compartment and an open position angularly related thereto for allowing passage of the waste debris from the first compartment into the second compartment, a third closure member pivotally mounted to the second end portion of the container assembly to control access to and exit from the second compartment, a handle member attached to and extending upwardly from the container assembly, and operator assemblies operable from the handle member for selectively controlling the opening and closing of the first and third closure members. The present device may optionally include a member slidably insertable within the second compartment for supporting a disposable bag liner in open position to receive the waste debris as it is transferred from the first compartment to the second compartment.

U.S. Pat. No. 4,741,566

Inventor: Byung-Do et al.

Issued: May 3, 1988

An apparatus for removing animal feces is provided that will conveniently collect and enclose feces into a receptacle wherein an improved scraping device is provided which opens outward of the receptacle in response to squeezing a trigger handle and which automatically in a scraping motion moves and encloses feces in the receptacle. In a modified form cleaning fluid is provided for flushing the apparatus.

U.S. Pat. No. 5,667,264

Inventor: Steve F. Tanahara

Issued: Sep. 16, 1997

An apparatus (10) for animal waste collection comprising a frame member (12). A disposable bag (14) is to receive animal waste (16) therein. An element (18) is for connecting a folded over mouth portion of the disposable bag (14) to the frame member (12) in a removable manner. An upright handle assembly (20) is also provided. A facility (22) is for coupling the frame member (12) with the disposable bag (14) to a bottom end of the upright handle assembly (20) in a removable manner. A person (24) can grasp the upright handle assembly (20), position the frame member (12) with the disposable bag (14) adjacent animal waste (16) deposited upon the ground (26), scoop the animal waster (16) into the disposable bag (14), disengage the upright handle assembly (20) from the frame member (12) and separate the disposable bag (14) from the frame member (12) to get rid of the disposable bag (14) with the animal waste (16).

While these animal waste retrieval devices may be suitable for the purposes for which they were designed, they would not be as suitable for the purposes of the present invention, as hereinafter described.

SUMMARY OF THE PRESENT INVENTION

The present invention discloses a device for collecting animal waste. The device has a generally upright standing handle member equipped with a trigger which communicates through a rod in the hollow body of the handle with a lower compartment door assembly for collecting the animal waste. The lower compartment is equipped with a front door which is pivotally connected to the trigger through the rod member. The lower compartment houses a slidably mounted tray therein which tray holds a disposable bag member in which bag the animal waste is placed after it is scooped into the lower compartment. The trigger is also equipped with a locking mechanism to hold the door open while waste is being placed therein.

A primary object of the present invention is to provide an apparatus for picking up animal waste and disposing of same without having contact with said animal waste.

Another object of the present invention is to provide an apparatus having a housing with one hinged door member located forwardly and an open end located rearwardly.

Yet another object of the present invention is to provide an apparatus with an insertable and removable container having a forwardly open end and a handle located on the exterior rearwardly end for the purpose of inserting said container into the housing.

Still yet another object of the present invention is to provide a plurality of disposable bags, each being unfolded and inserted into said removable/insertable container when needed and said removable/insertable container will be inserted into the rear of the apparatus.

Another object of the present invention is to provide an apparatus having a housing, a removable/insertable container, a disposable bag and holding means for said apparatus in the form of a long handle which has a trigger for opening and closing said hinged member and wherein said handle forms a loop whereby said apparatus can be hooked on forearm when not in use.

Yet another object of the present invention is to provide a locking mechanism for said trigger having an external button wherein when said trigger is depressed and said button is depressed, said trigger will remain fixed thereby maintaining the hinged door member in the open position and when the button on the other side of the handle is depressed, the locking mechanism will disengage the trigger and the hinged door member will close.

Still yet another object of the present invention is to provide said disposable bag with a sealable flap with a removable paper strip to protect the gummed edge of said flap whereby the removable/insertable container will be removed from the apparatus, the paper tape will be removed and the flap will cover the opening and seal the container for sanitary disposable purposes.

Additional objects of the present invention will appear as the description proceeds.

The present invention overcomes the shortcomings of the prior art by providing an apparatus with means for inserting a disposable bag into a container and having means for angularly extending said container and having means for opening a hinged member and scooping animal waste into said container which is lined with a disposable bag wherein said bag will be removed at the users discretion and disposed.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
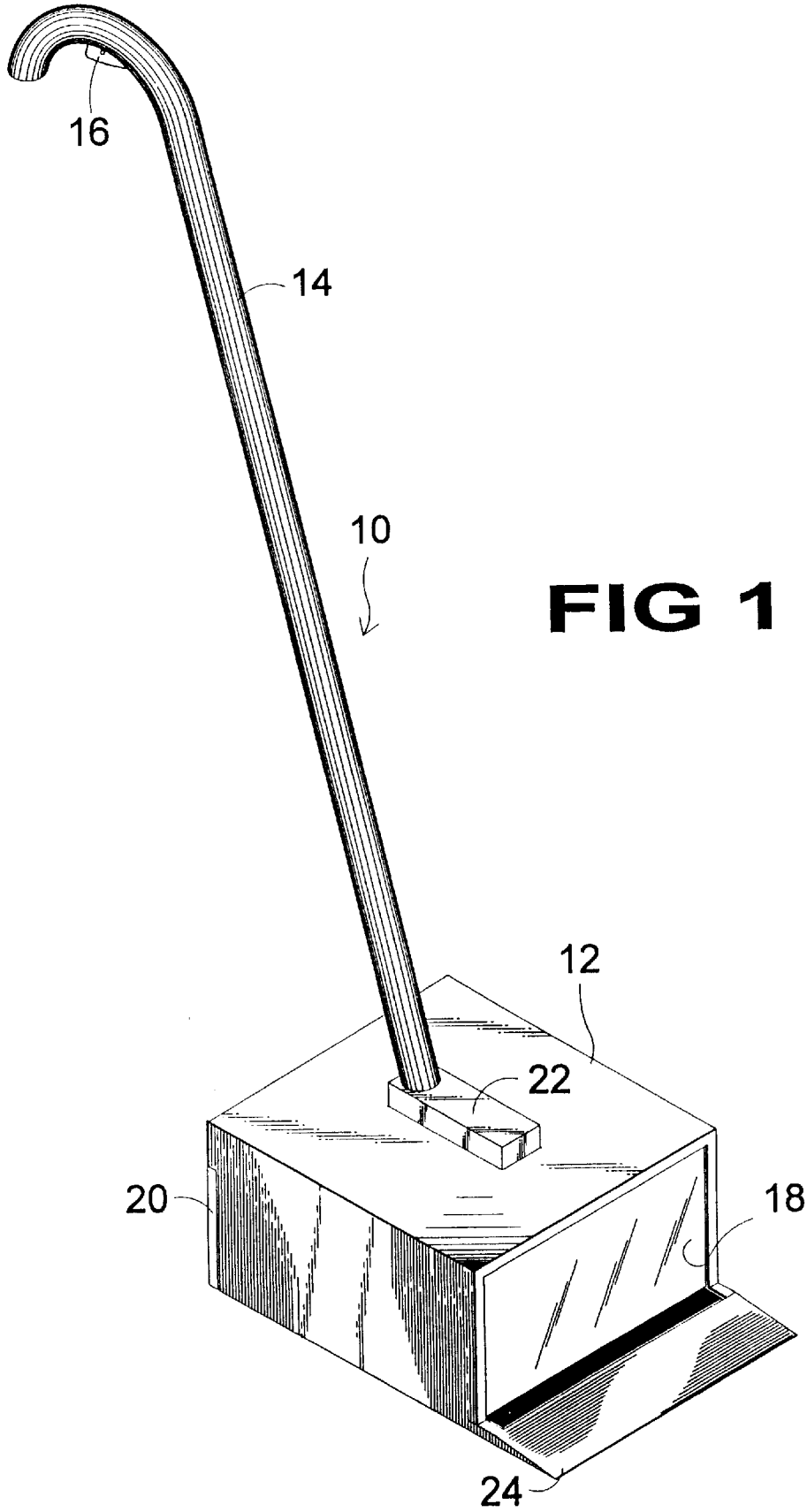
FIG. 1 is a front perspective view of the present invention showing the raised center portion which will accommodate the door mechanism of the present invention.

With regard to the reference numerals used, the following numbering is used throughout the various figures.

| | |
|---|---|
| 10 | present invention |
| 12 | compartment |
| 14 | handle |
| 16 | trigger |
| 17 | trigger lock |
| 18 | front door |
| 20 | rear door tray |
| 22 | handle mounting means |
| 24 | lip of compartment |
| 26 | door connecting means |
| 28 | rear tray handle |
| 30 | trigger rod |
| 32 | door spring |
| 34 | connecting means |
| 36 | connecting means |
| 38 | pivot member |
| 40 | attachment means |
| 42 | pivot member |
| 44 | pivot member |
| 46 | pivot points |
| 48 | second spring member |
| 50 | door pivot point |
| 52 | disposable container |
| 54 | cardboard sides |
| 55 | rigid support |
| 56 | non-permeable bottom |
| 57 | stop |
| 58 | paper covering |
| 60 | gummed edge |
| 62 | flap |

DESCRIPTION OF THE PREFERRED EMBODIMENTS

Turning now descriptively to the drawings, in which similar reference characters denote similar elements throughout the several views, FIGS. 1 through 15 illustrate the present invention being a device for collecting animal wastes.

Turning to FIG. 1, therein is shown a front perspective view of the present invention generally shown at 10. Shown therein is the lower compartment 12 of the present invention positioned at ground level being an enclosure for the waste receptacle having openings on its front and rear ends. The generally upright standing handle 14 is provided to operate the lower enclosure which handle is equipped with a trigger 16. Also shown therein is the front door 18 and the rear tray door 20 of the compartment. Further shown therein is the mounting means 22 for the handle 14 for attaching it to the compartment 12. Also shown on the front side of the lower compartment 12 is a raised lip 24 for scooping up the animal waste.

Figure 2:
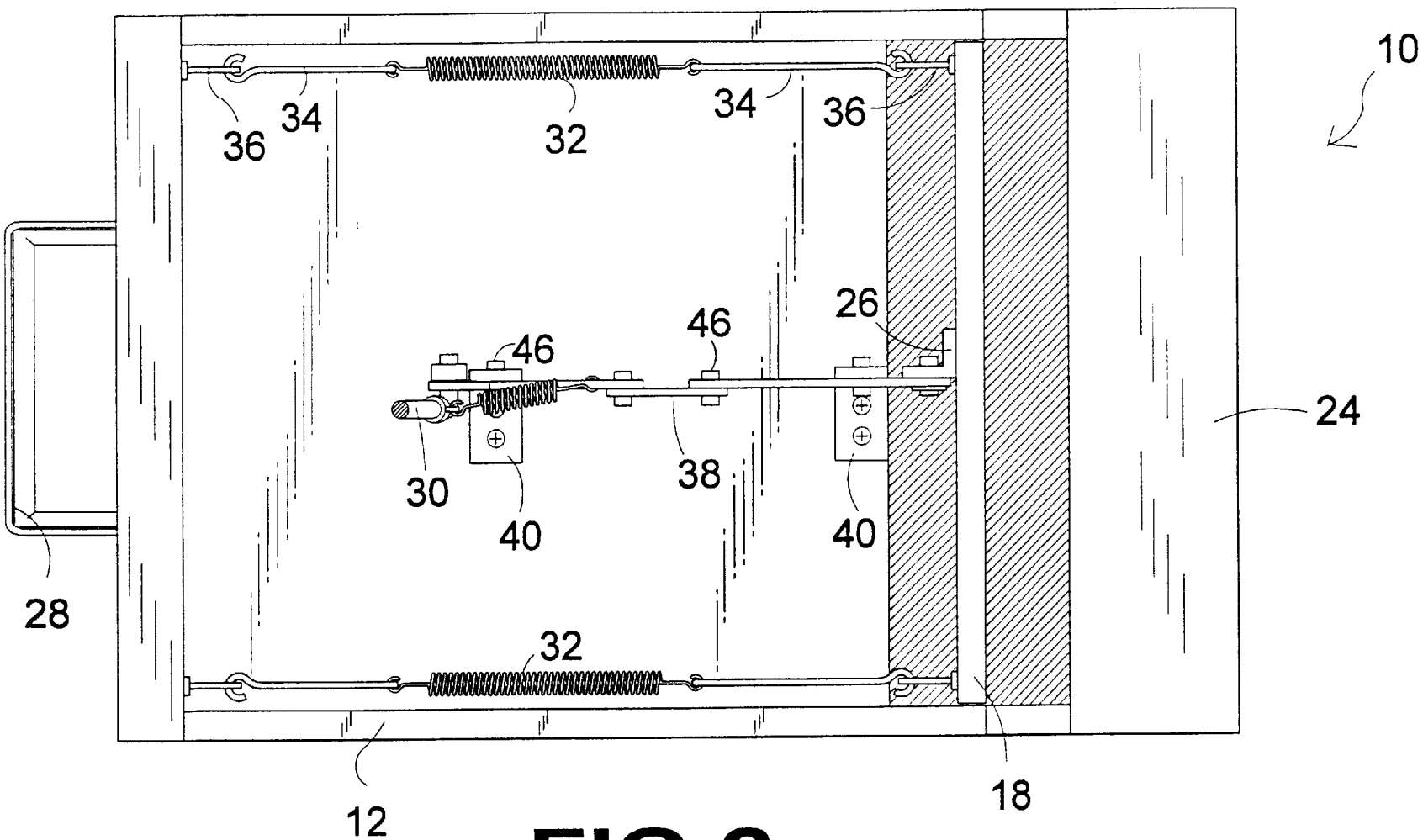
FIG. 2 is a top plan cutaway view of the present invention showing the door mechanism. The springs located on each side will close the door when the trigger is released.

Turning to FIG. 2, therein is shown a top plan cutaway view of the present invention 10 showing the door mechanism 18. Therein is shown the compartment 12 having a front door 18 and rear sliding tray having a handle 28 thereon. Also shown is the front lip 24 of the compartment. The trigger rod 30 is shown which operates and connects the trigger on the handle (not shown) to the pivotal means 38 which operates the front door 18. Springs 32 are shown on each side of the door for resiliently retracting the door when the trigger is released. Connecting means for the springs are shown at 34 and at 36 for connecting the springs to the front door and the rear door. The pivot members 38 operate and connect the door 18 with the trigger rod 30. Means for attaching the pivot members 38 to the enclosure 12 are shown at 40 and for attaching to the front door 18 is shown at 26.

Figure 3:
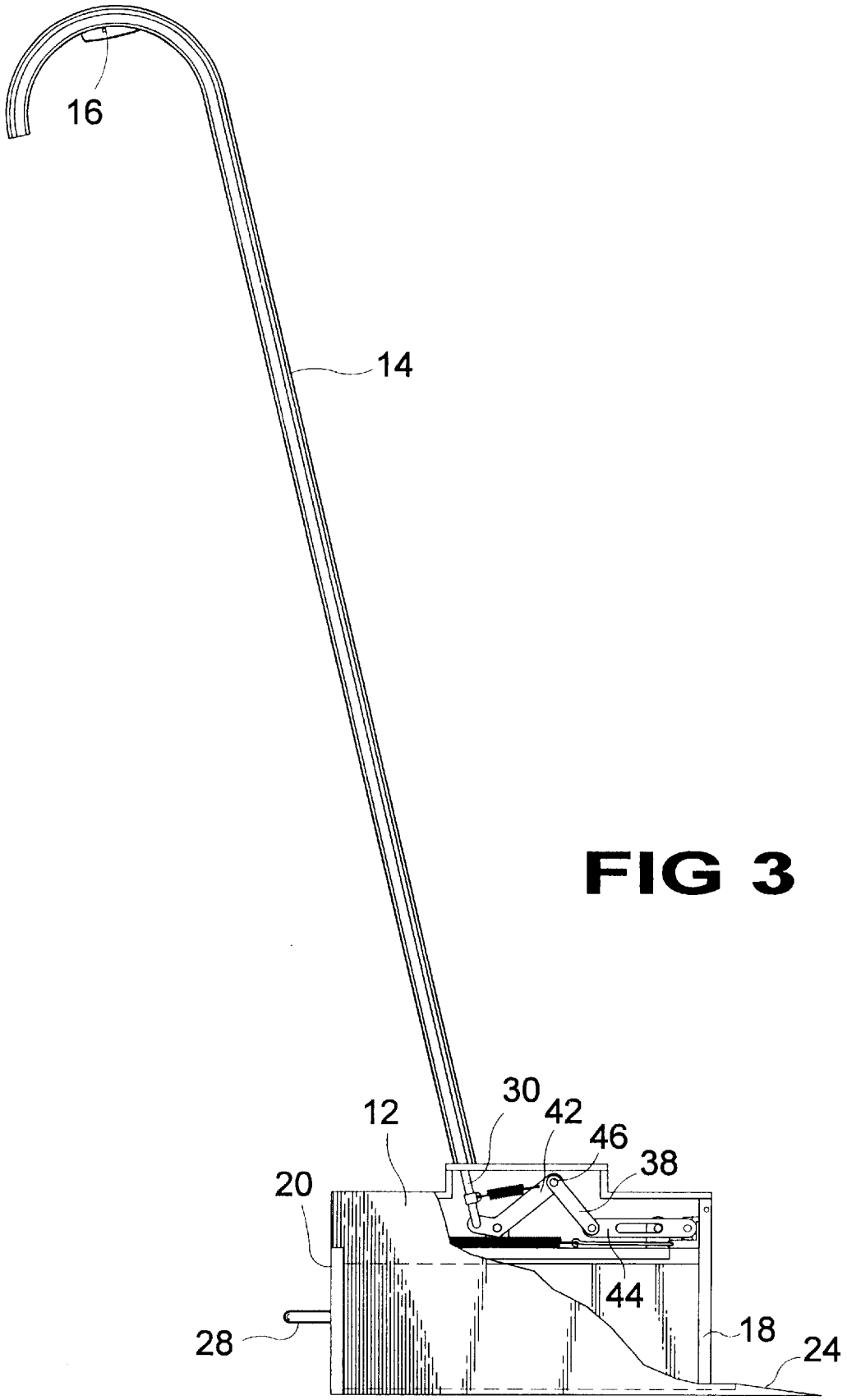
FIG. 3 is a side view of the present invention shown as a cutaway view of the container showing the door mechanism which is engaged by using the trigger located on the handle. Also the trigger can be locked in the depressed position by pressing the locking button which will keep the door in the open position until the locking mechanism is pushed from the other side which will release the trigger and the springs will close the door when the trigger is released.

Turning to FIG. 3, therein is shown a side view of the present invention 10 shown as a cutaway view of the enclosure 12 showing the front door mechanism 18 which is engaged by use of the trigger 16 located on the handle 14. Also the trigger 16 can be locked in the depressed position by pressing the locking button (not shown) which will keep the door 18 in the open position until the locking mechanism is pushed on the other side which will release the trigger 16 and the springs 32 will close the door 18 when the trigger 16 is released. Also shown therein is the rear tray door 20 along with its handle 28, along with the front lip 24 of the compartment 12. It can be seen that the trigger rod 30 is connected to the trigger 16 through the hollow rod 14. Also shown therein are the several pivot members 38, 42 and 44 each having pivot means 46.

Figure 4:
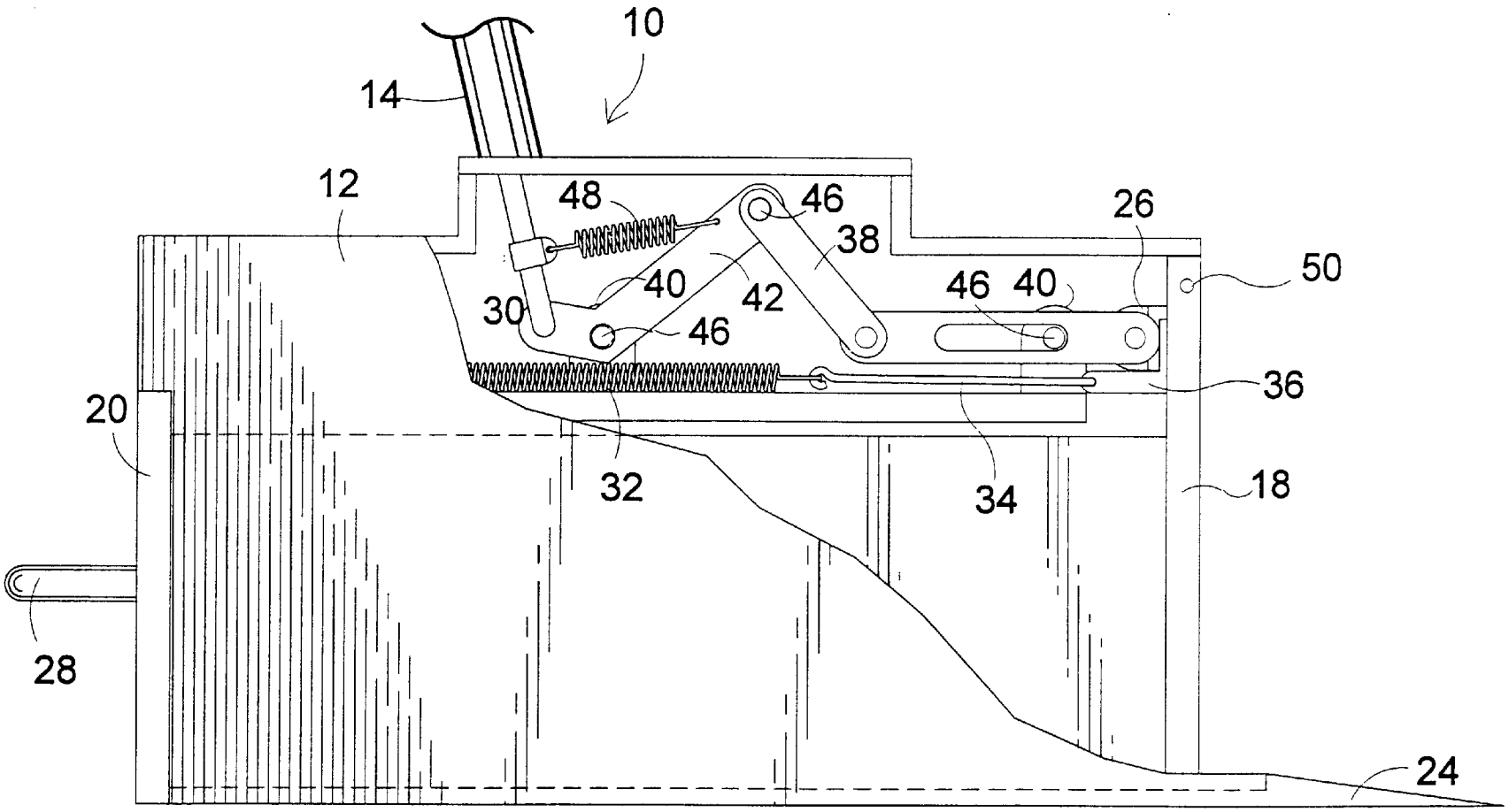
FIG. 4 is an enlarged side cutaway view of the present invention showing the door mechanism.

Turning to FIG. 4, therein is shown an enlarged cutaway view of the present invention 10 showing the door mechanism 18. Therein is shown the enclosure 12 showing the front door mechanism 18 which is engaged by use of the trigger 16 located on the handle 14. Also shown therein is the rear tray door 20 along with its handle 28, along with the front lip 24 of the compartment 12. It can be seen that the trigger rod 30 is connected by means to member 42 and the trigger 16 through the hollow rod 14. Also shown therein are the several pivot members 38, 42 and 44 each having pivot means 46 along with connecting means 34 and 36 for connecting the spring members 32 to the front door 18. Also shown is an additional spring 48 attached to the trigger rod 30 and member 42 for urging the pivot member 42 toward the trigger rod 30 which helps retain the door 18 in a normally closed position. Also shown is the pivot point 50 of the front door hinge near its upper edge. It should be clear that the trigger rod 30 moves upwardly due to the user squeezably engaging the trigger so that the pivot member 44 slidably moves about its pivot points which causes the front door 18 to be moved about its hinge 50 in a direction away from the enclosure 12 so that the front door 18 becomes open.

Figure 5:
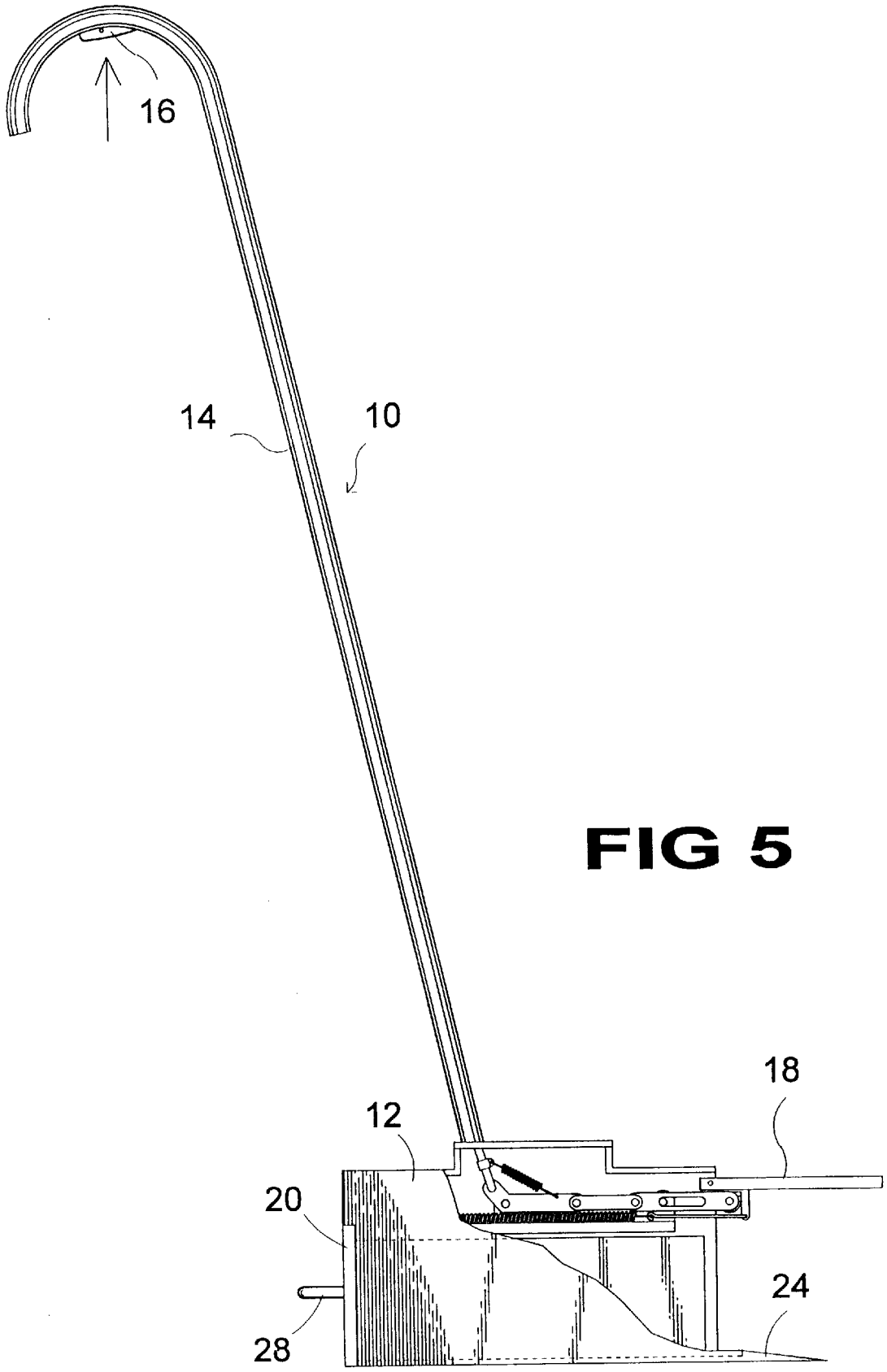
FIG. 5 is a side cutaway view of the present invention showing the door in the open position and the corresponding position of the various components of the door mechanism.
Figure 6:
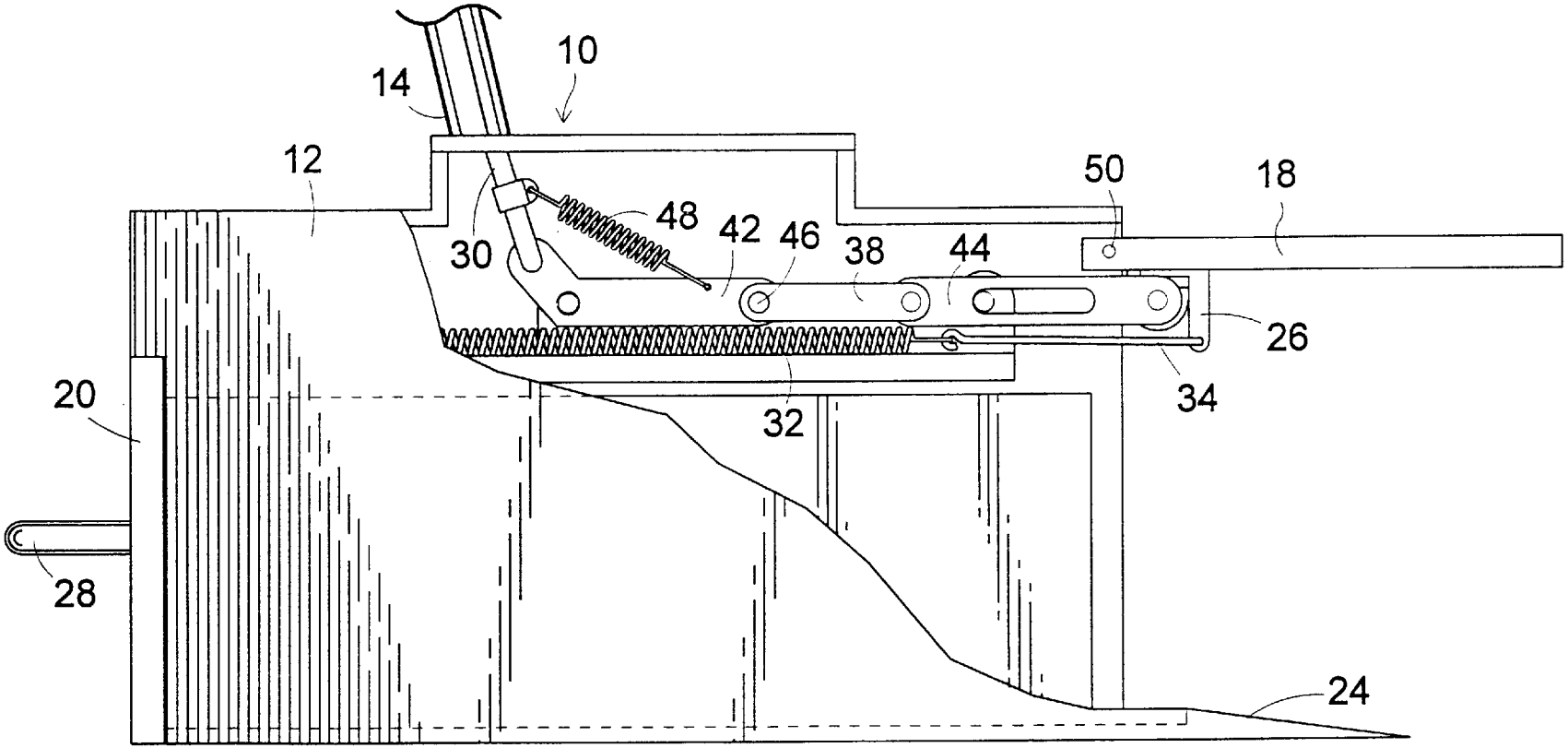
FIG. 6 is an enlarged side cutaway view of the present invention showing the door in the open position and the corresponding position of the various components of the door mechanism.

Turning to FIG. 5, therein is shown a side cutaway view of the present invention 10 showing the front door 18 in the open position with the corresponding positions of the various components of the door mechanism which will be shown in greater detail in FIG. 6 which follows.

Turning to FIG. 6, therein is shown an enlarged side view of the present invention 10 showing the front door 18 in the open position and the corresponding position of the various components of the door mechanism. Therein is shown a side view of the present invention 10 shown as a cutaway view of the enclosure 12 showing the front door mechanism 18 which is engaged by use of the trigger 16 located on the handle 14. Also shown therein is the rear tray door 20 along with its handle 28, along with the front lip 24 of the compartment 12. It can be seen that the trigger rod 30 is connected to the trigger 16 through the hollow rod 14. Also shown therein are the several pivot members 38, 42 and 44 having pivot means 46 along with the connecting means 34 and 36 for connecting the spring members to the front door 18. Also shown is an additional spring 48 for urging the pivot member 42 toward the trigger rod 30 along with the pivot point 50 of the front door hinge. It should be clear that when the trigger rod 30 moves upwardly, the pivot member 44 slidably moves along its pivot point which causes the front door 18 to be moved about its hinge 50 in a direction away from the enclosure 12 so that the front door 18 becomes open.

Figure 7:
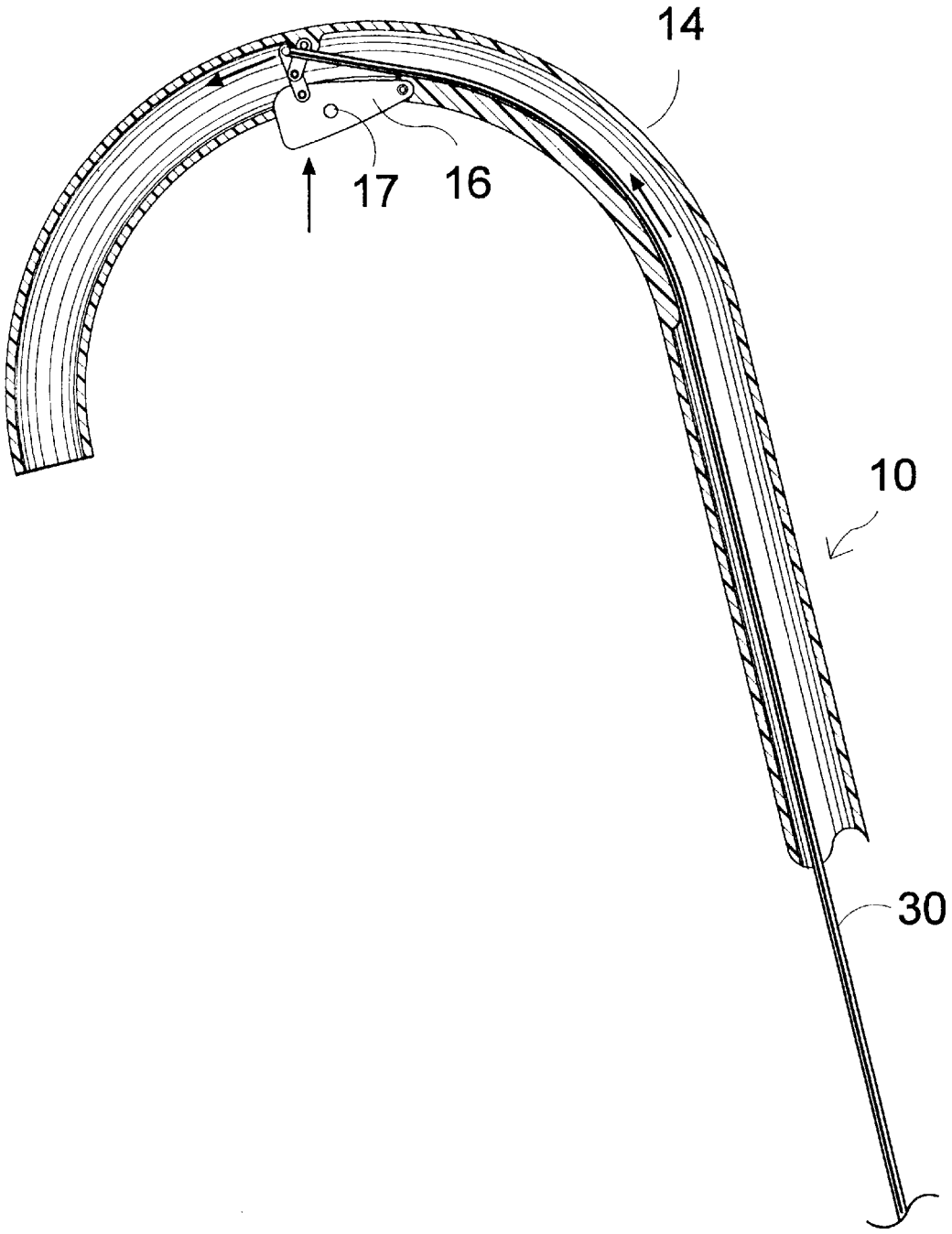
FIG. 7 is an exploded view of the handle and trigger assembly of the present invention. The arrows indicate directional movement of the trigger mechanism in opening the door. Also shown is the locking button which when depressed will keep the trigger in the depressed position until the button is pushed from the other side releasing the trigger. Also shown is the hooked shape of the handle for purposes of carrying the apparatus.

Turning to FIG. 7, therein is shown an exploded view of the handle 14 and the trigger 16 of the present invention 10 which trigger is operable by the fingers of the hand of the user grasping the handle. The arrows indicate directional movement of the trigger mechanism 16 and rod 30 in opening the door 18. Also shown is the locking button 17 which when depressed will keep the trigger 16 in the depressed position until the button 17 is pressed from the other side releasing the trigger 16. Also shown is the hook or curved shape of the handle at its upper end for purposes of carrying the apparatus 10 on the arm of the user.

Figure 8:
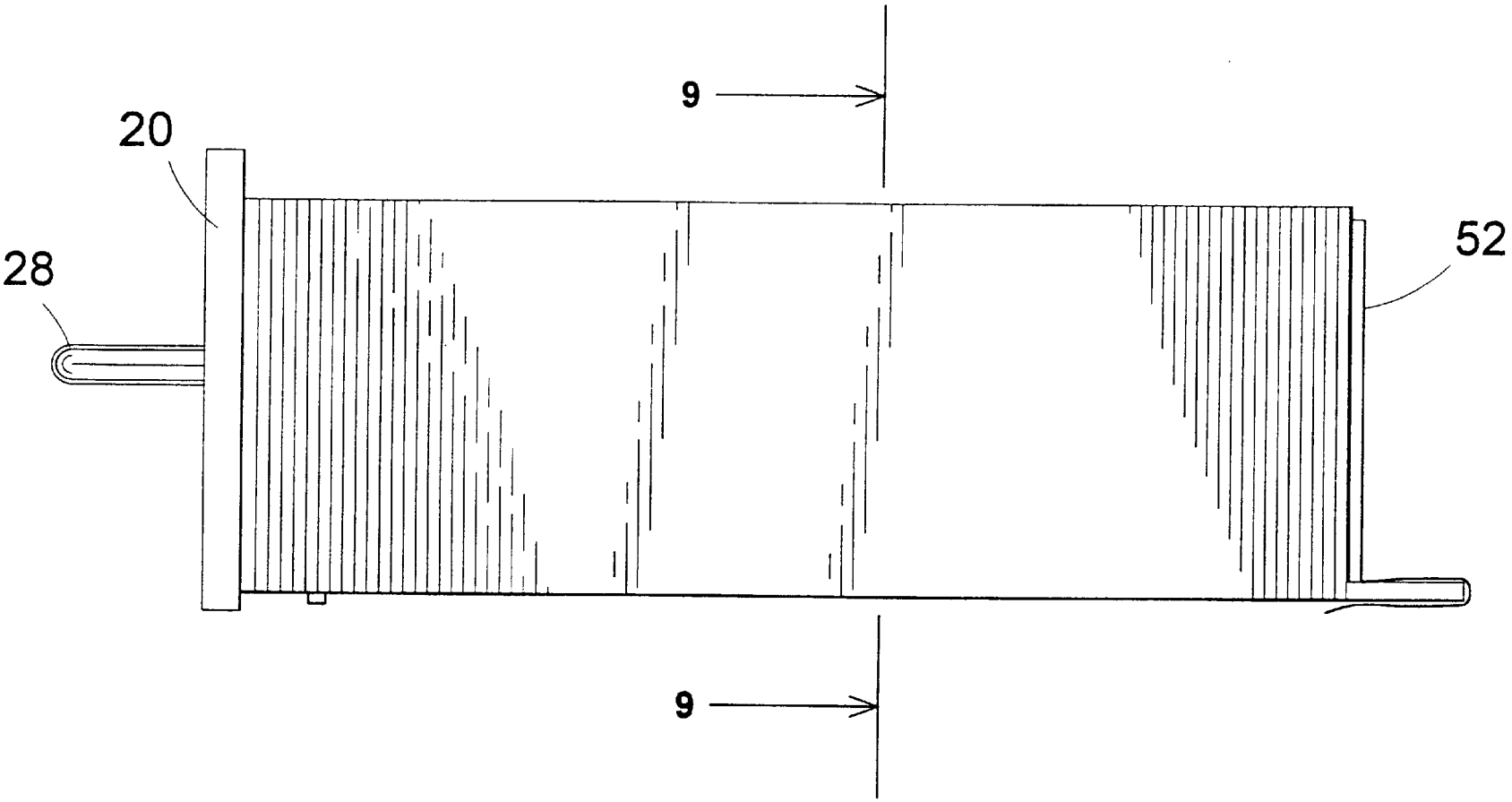
FIG. 8 is a side elevational view of the present invention showing the removable drawer which houses the disposable container.

Turning to FIG. 8, therein is shown a side elevation view of the present invention showing the slidably insertable and removable receptacle tray or drawer 20 which supports and houses the disposable waste container 52 which is a bag-like member for receiving wastes. Also shown is the drawer handle 28. The tray 20 is located on the opposite end of the enclosure from the front door and is inserted and removed from the end opposite the front door.

Figure 9:
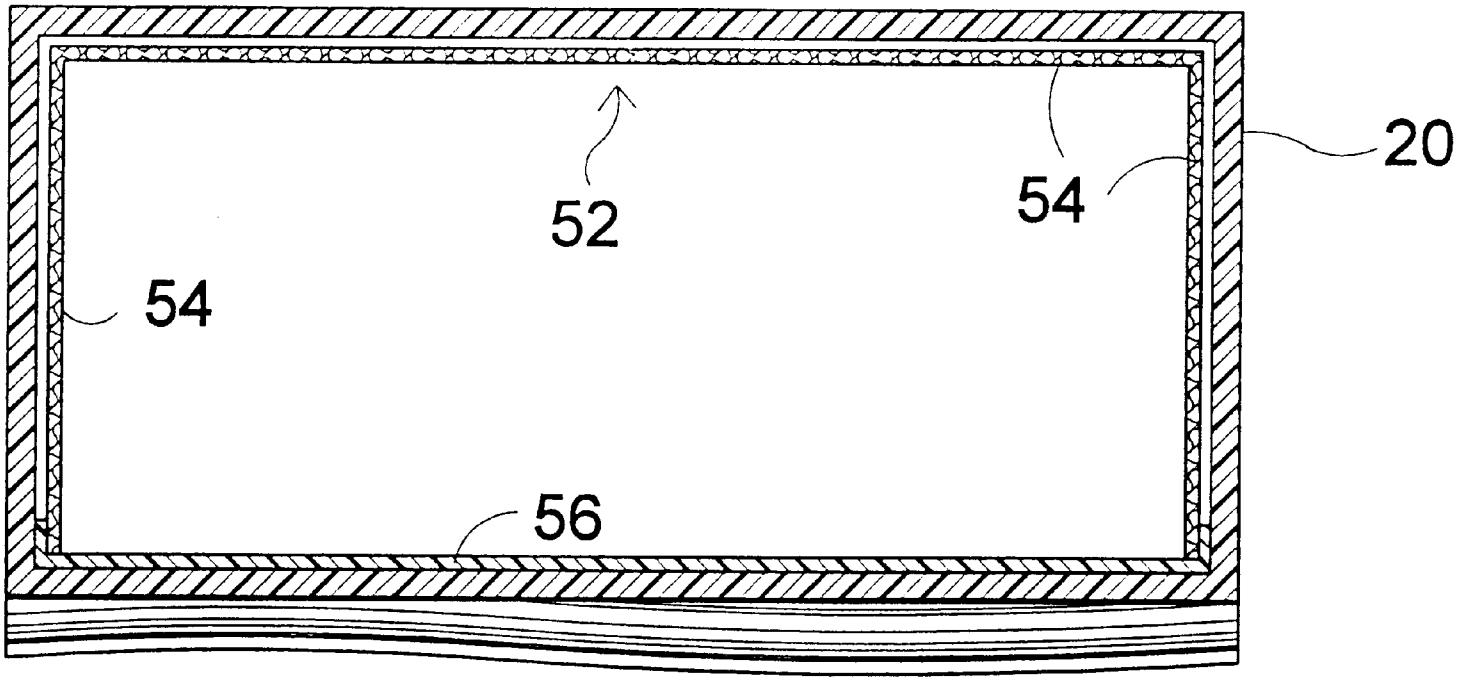
FIG. 9 is a cross sectional view of the removable drawer, taken from FIG. 8 as indicated, showing the housing of the removable drawer and the disposable container having three sides made from a cardboard-like material for structural integrity and a bottom side made of non-permeable plastic.

Turning to FIG. 9, therein is shown a cross sectional view of the removable drawer 20 taken from FIG. 8 as indicated, showing the housing of the removable drawer 20 and the interior removable disposable container 52 having three sides made from a paper-like or cardboard-like material 54 for structural integrity and a bottom side made of nonpermeable plastic-like material 56 to prevent waste leakage.

Figure 10:
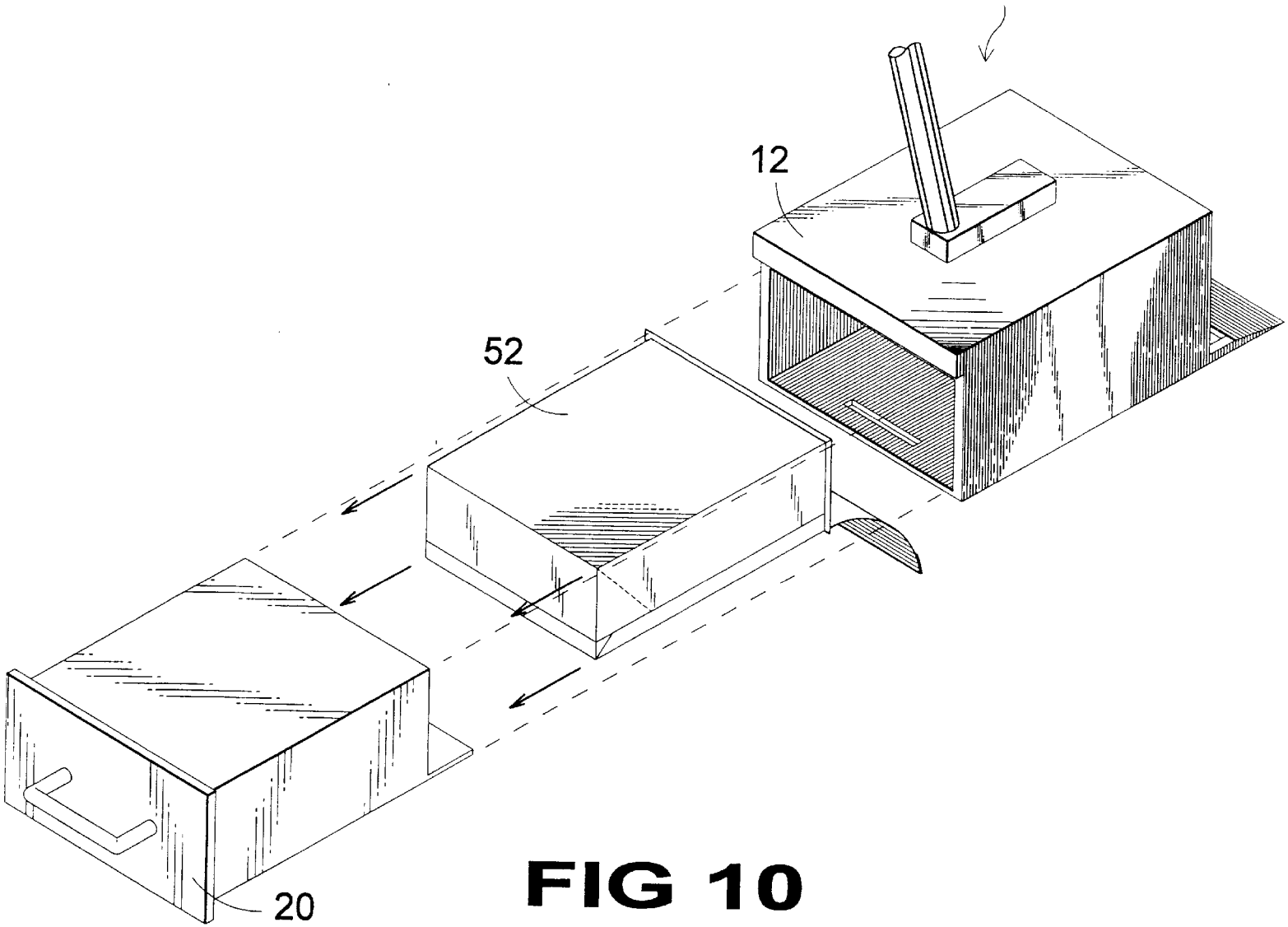
FIG. 10 is an exploded view of the major components of the present invention. Shown are the outside container having means for inserting a removable container having a disposable container inserted therein.

Turning to FIG. 10, therein is shown is an exploded view of the major components of the present invention 10. Shown are the outside enclosure 12 having means for slidably inserting a removable drawer 20 having a disposable container 52 enclosed therein. It should be clear that in operation the disposable waste container 52 fits inside the drawer 20 which then is inserted inside the enclosure 12.

Figure 11:
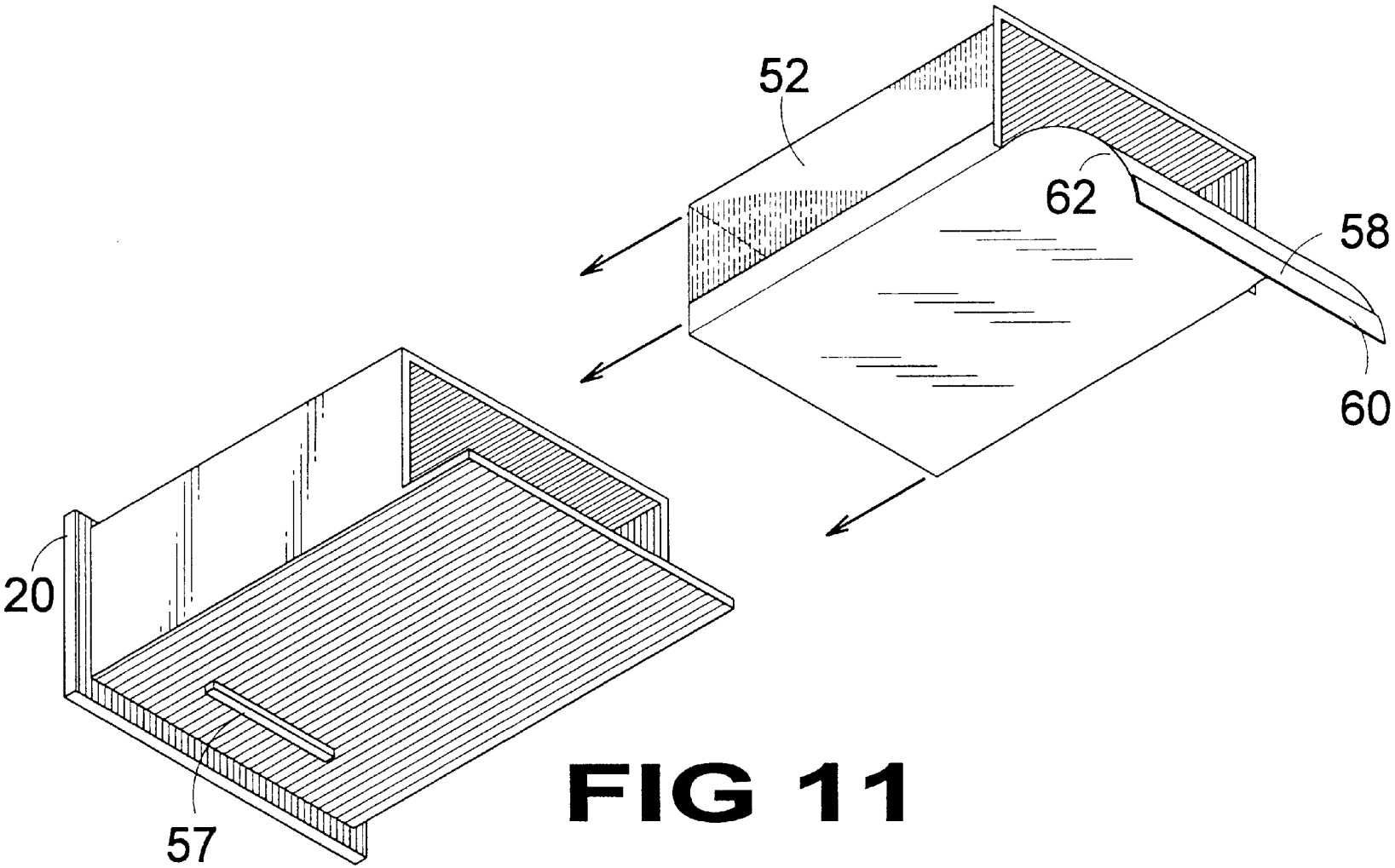
FIG. 11 is a bottom perspective view of the removable container which has holding means in the form of a stop block to maintain its position within the main body of the device. Also shown is the disposable container having a removable paper covering over the gummed edge of the flap which will allow the disposable container to be sealed after use before discarding.

Turning to FIG. 11, therein is shown a bottom perspective view of the removable drawer 20 which has holding means 57 in the form of a stop block to positively maintain its position within the enclosure 12. Also shown is the disposable container 52 having a removable paper covering 58 over the gummed edge 60 of the sealable flap 62 which will allow the disposable container 52 to be sealed after use before discarding the waste.

Figure 12:
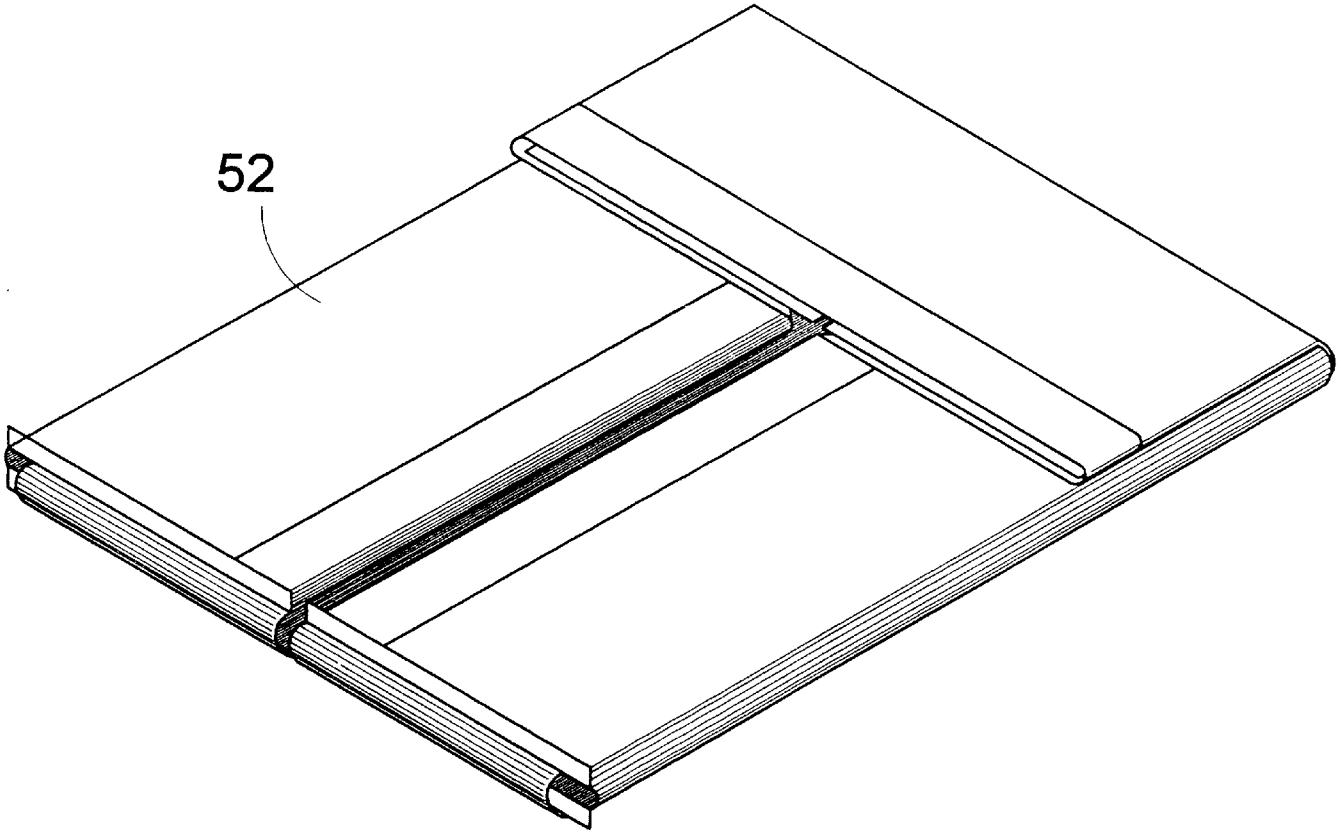
FIG. 12 is a perspective view of the disposable container in its folded position prior to installation in the device.

Turning to FIG. 12, therein is shown a perspective view of the disposable container 52 in its folded position prior to placement in the device.

Figure 13:
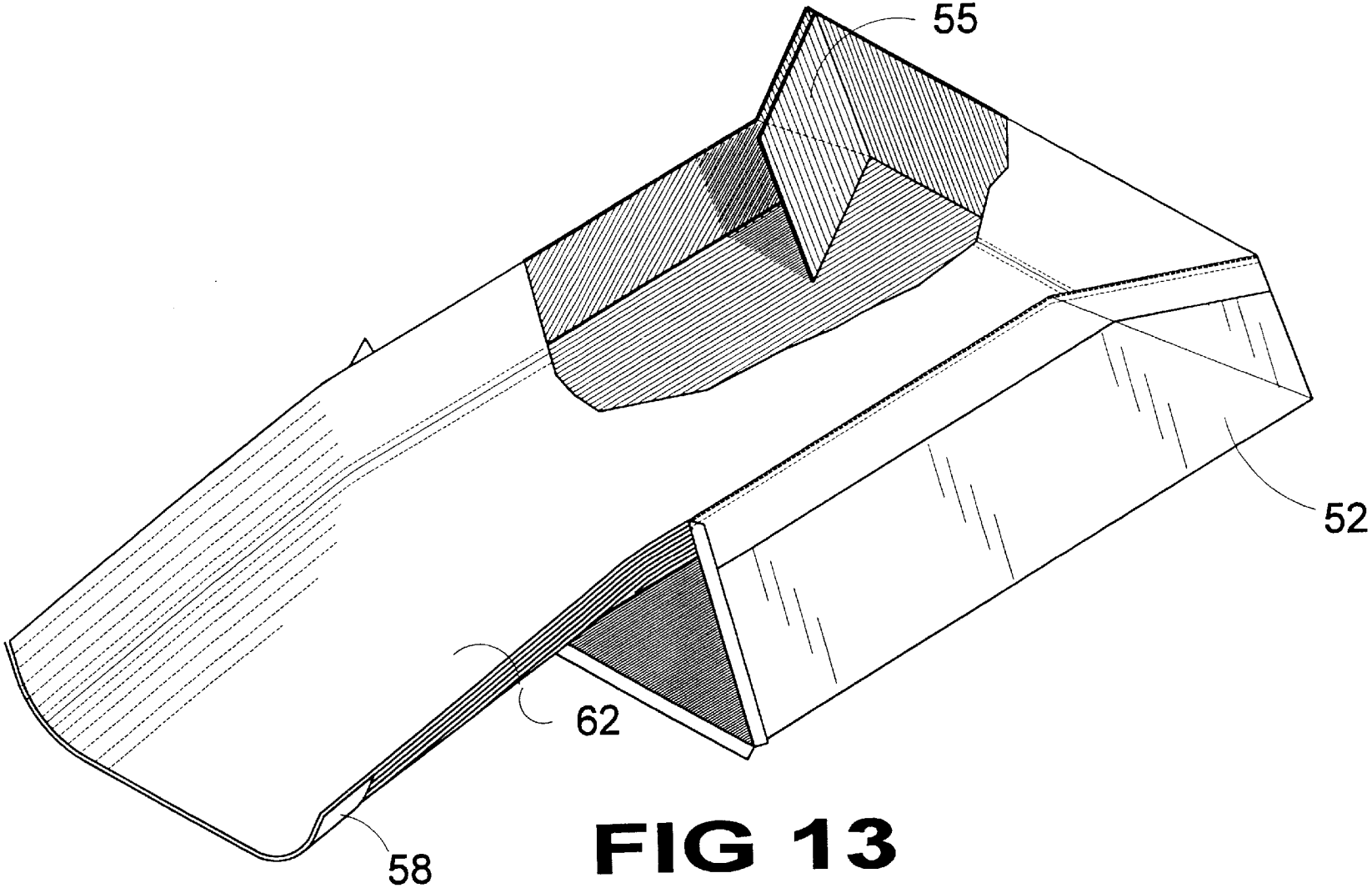
FIG. 13 is a perspective cutaway view of the disposable container in a partially unfolded condition. Shown is one of two rigid support member moving to the open position which will provide rigidity to the disposable container.

Turning to FIG. 13, therein is shown a perspective cutaway view of the disposable container 52 in a partially unfolded condition. Shown is one of the two rigid support members 55 moving to the open position which will provide rigidity to the disposable container. Also shown is the flap 62 and paper covering 58.

Figure 14:
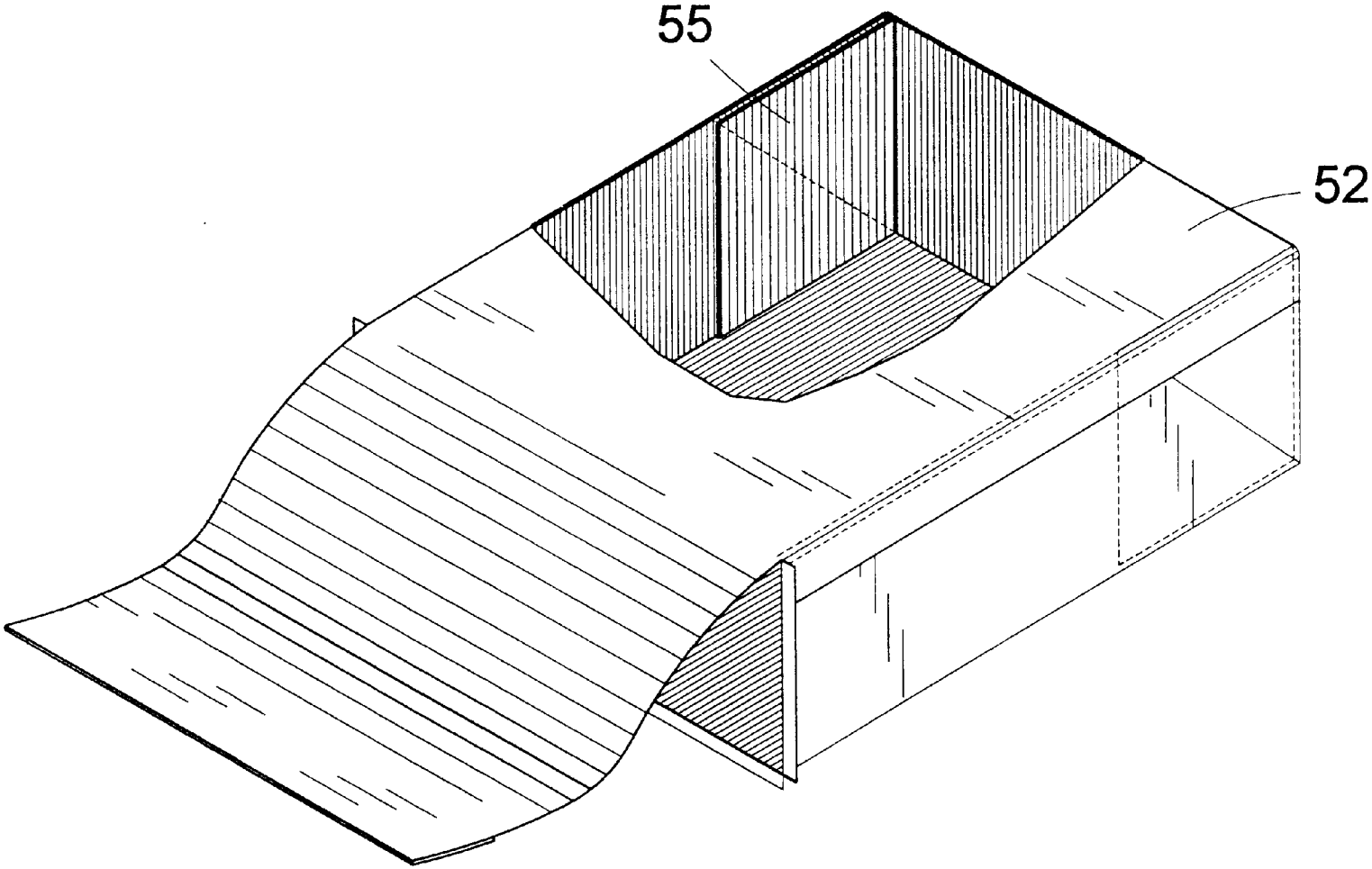
FIG. 14 is a perspective cutaway view of the disposable container in the fully open position. Shown is one of two rigid support members which will provide rigidity to the container once the container is placed in the open position.

Turning to FIG. 14, therein is shown a perspective cutaway view of the disposable container 52 in the fully open position. Shown is one of the two rigid support members 55 which will provide rigidity to the container.

Figure 15:
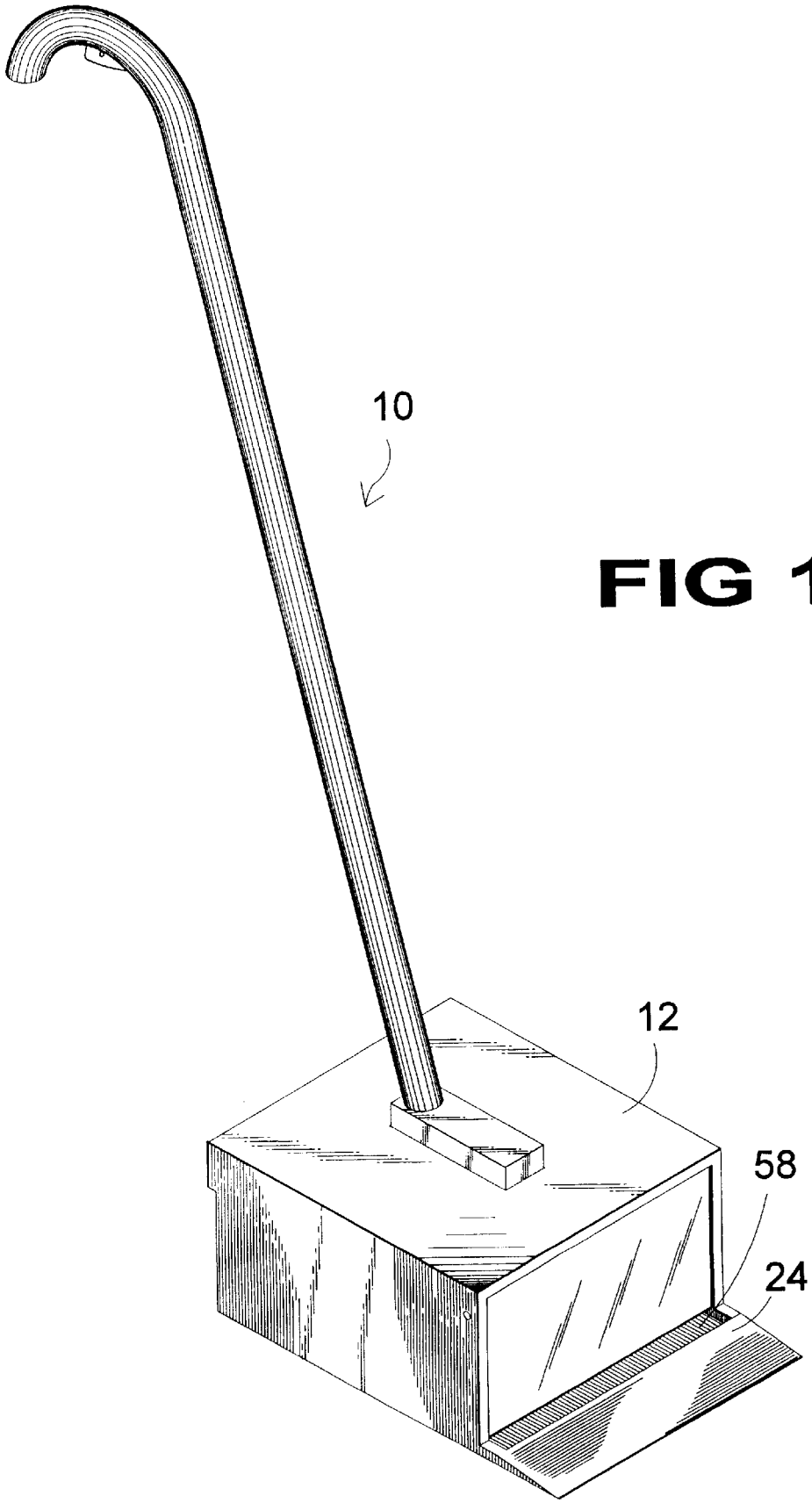
FIG. 15 is a front perspective view of the present invention with the removable container removed showing the lip of the container which is engaged by the disposable bag to form a uniform transition into the disposable bag and to protect the gummed label flap from contamination by fecal material.

Turning to FIG. 15, therein is shown a front perspective view of the present invention 10 with the removable tray removed showing the lip 24 of the container 12 which is engaged by the paper covering 58 of the front edge of the disposable bag (not shown) to form a uniform transition into the disposable bag and to protect the gummed label flap from contamination by fecal material.

What is claimed is new and desired to be protected by Letters Patent is set forth in the claims:

1. An apparatus for collecting animal waste, comprising:

a) a handle;

b) an enclosure positioned at ground level;

c) means for attaching a lower end of said handle to said enclosure;

d) said enclosure having a front door mounted thereon pivoted outwardly and upwardly into an open position about a pivot mounted adjacent a top edge of said enclosure and said enclosure having a fixed front lip extending at ground level outwardly of said enclosure with said front door in the closed position;

e) said enclosure having a rear tray slidably mounted therein, said rear tray having a rear vertical wall, a bottom wall, and a pair of vertical side walls and a fixed front lip extending out from said tray which overlaps a portion of said enclosure fixed front lip when said rear tray is in place within said enclosure, said rear tray having a front opening facing said front door of said enclosure to receive fecal matter when said door is in the open position;

f) a disposable waste container within said rear tray having an opening adjacent the front opening in said rear tray facing said front door, said disposable waste container having a flexible bottom extension for being folded over and under the fixed front lip of said rear tray, said bottom extension having at a free edge thereof an adhesive strip for sealing said disposable waste container after said waste container is removed from said rear tray and said bottom extension is folded over the opening into said disposable waste container;

g) said handle having a trigger means attached thereto for opening and closing said front door; and, h) said trigger means including a spring for biasing said door in the closed position, a spring for biasing said trigger means in the door closed position, and a releasable lock for holding said trigger means in the door open position, said springs being located within said enclosure.

2. The apparatus of claim 1, wherein said handle is curved at its upper end whereby it can be hung over the arm of the user.

3. The apparatus of claim 2, wherein said trigger means is positioned in the curved end of said handle said trigger means being operable by the fingers of the hand of the user grasping said handle.

4. The apparatus of claim 1, wherein said rear tray is positioned on the opposing end of said enclosure distal to said front door.

5. The apparatus of claim 4, wherein said rear tray is slidably mounted from the rear end of said enclosure distal to said front door.

6. The apparatus of claim 5, said rear tray further comprising means for locking onto said enclosure whereby said tray is positively positioned in said enclosure.

7. The apparatus of claim 1, wherein said disposable waste container further comprises a paper-like material and a nonpermeable material.

8. The apparatus of claim 7, wherein said disposable waste container further comprises three sides comprising paper-like material and one side comprising a nonpermeable material.

9. The apparatus of claim 8, wherein said disposable waste container further comprises multiple rigid corner members whereby said container is more rigidly mounted.

* * * * *